US012215491B1

(12) United States Patent
Fix

(10) Patent No.: US 12,215,491 B1
(45) Date of Patent: Feb. 4, 2025

(54) KITCHEN SINK

(71) Applicant: Chris Fix, Harwood, ND (US)

(72) Inventor: Chris Fix, Harwood, ND (US)

( * ) Notice: Subject to any disclaimer, the term of this patent is extended or adjusted under 35 U.S.C. 154(b) by 96 days.

(21) Appl. No.: 17/950,351

(22) Filed: Sep. 22, 2022

(51) Int. Cl.
*E03C 1/186* (2019.01)
*E03C 1/182* (2006.01)

(52) U.S. Cl.
CPC ..... *E03C 1/186* (2013.01); *E03C 1/182* (2013.01)

(58) Field of Classification Search
CPC ..... E03C 1/186; A47K 3/14
See application file for complete search history.

(56) References Cited

U.S. PATENT DOCUMENTS 1,817,330 A 8/1931 Wilson, Jr.
2,109,089 A 2/1938 Moyes
2,765,476 A 10/1956 Moore
3,346,886 A * 10/1967 Kashiwamura ..... E03C 1/186 108/134
3,579,668 A * 5/1971 Aronovitz ..... A47K 3/122 4/578.1
4,333,188 A 6/1982 Jensen et al.
5,423,095 A * 6/1995 Bearer ..... A47K 3/14 4/514
D544,587 S 6/2007 Bouhassira
7,721,362 B2 * 5/2010 Martin ..... E03C 1/186 220/532
8,635,718 B1 1/2014 Giagni, Sr. et al.
10,337,178 B2 * 7/2019 Bomatter ..... F16J 15/10
11,857,119 B2 * 1/2024 Detlaff ..... E03C 1/18
2015/0128339 A1 * 5/2015 Warner ..... E03C 1/186 4/514

FOREIGN PATENT DOCUMENTS

GB 2223674 A * 4/1990 ..... E03C 1/186

* cited by examiner

*Primary Examiner* — Erin Deery
(74) *Attorney, Agent, or Firm* — Cramer Patent & Design PLLC; Aaron R. Cramer

(57) ABSTRACT

The present invention is directed to a kitchen sink with hinged divider. The kitchen sink with hinged divider may comprise a sink and a divider. The divider may pivot between a divided position and a non-divided position. The divider may separate a first section of the sink from a second section of the sink when the divider is in the divided position. The first section of the sink and the second section of the sink may be joined when the divider is in the non-divided position. The sink may be operable as two smaller basins when the divider is pivoted to the divided position and as one large basin when the divider is pivoted to the non-divided position.

1 Claim, 8 Drawing Sheets

KITCHEN SINK

RELATED APPLICATIONS

None

FIELD OF THE INVENTION

The present invention relates generally to a kitchen sink and more specifically to a kitchen sink having enhanced features.

BACKGROUND OF THE INVENTION

Perhaps the most commonly used item in the kitchen is not the refrigerator or the stove, but the kitchen sink. Sinks play an important role from initial meal prep, cooking of the food, and ultimately cleanup as well. Just about all sinks fall into the single bowl or double bowl variety. Single bowls accommodate the largest of pots, pans, and trays when filling with water or when cleaning them afterwards. Double bowl sinks are ideal for accommodating two different processes such as washing in one and rinsing in the other. They also do not use as much water to fill them should only a small footprint of water be needed.

Unfortunately, one must decide on which type of sink to install during initial install or major remodeling and then be forced to live with that decision along with the associated disadvantages. Accordingly, there exists a need for a means by which the benefits of both a single bowl and a double bowl sink can be realized without the associated disadvantages. The development of the kitchen sink fulfills this need.

SUMMARY OF THE INVENTION

The principles of the present invention provide for a kitchen sink that has a sink having a first section and a second section, and a divider pivoting between a divided position and a non-divided position. The first section includes a first drain aperture, and the second section includes a second drain aperture. The divider is disposed between the first section of the sink from the second section of the sink.

The first drain aperture may be coupled to a plurality of plumbing and may be operable to drain the first section. The second drain aperture may be coupled to the plumbing and may be operable to drain the second section. The second section may include a pocket. The pocket of the second section may provide full capture of the divider when the divider is pivoted to the non-divided position. The pocket may be a recessed area at a rear wall of the second section of the sink. The sink may include a pivot axis. The pivot axis may be located at a rear of the sink adjacent between the first section and the second section and within a rear inner wall of the pocket of the second section. The pivot axis may be a vertically-oriented shaft that establishes an axis of rotation of the divider. The sink may include a rim. The rim may be a lip that surrounds a top of the sink such that the sink may be adapted to be lowered into a sink aperture of a countertop. The divider may separate the first section of the sink from the second section of the sink when the divider is in the divided position. The first section of the sink and the second section of the sink may be joined when the divider is in the non-divided position. The sink may be operable as a first basin and a second basin when the divider is pivoted to the divided position. The first basin may be smaller than the second basin. The sink may be operable as a combined singular maximized basin when the divider is pivoted to the non-divided position. The first drain aperture, the second drain aperture, or both may be operable to drain the combined singular maximized basin when the divider is in the non-divided position. The divider may include a seal. The seal may be a rubberized material that creates a watertight barrier between the first section and the second section that may prevent intermixing between the first section and the second section. The divider may be a hinged divider.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
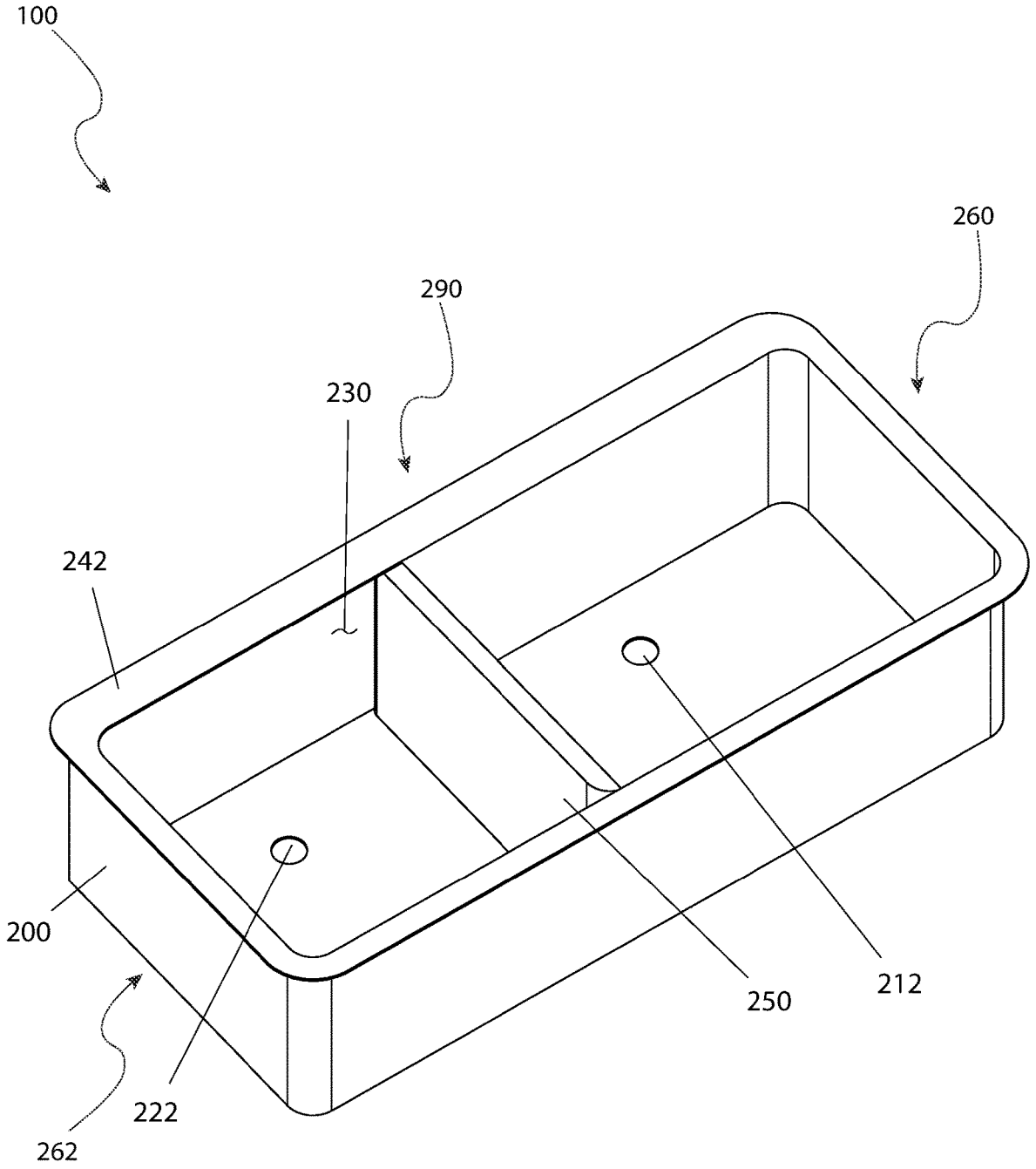
FIG. 1 is an isometric view of a kitchen sink with hinged divider, according to an embodiment of the present invention, illustrating the divider in the divided position.
Figure 2:
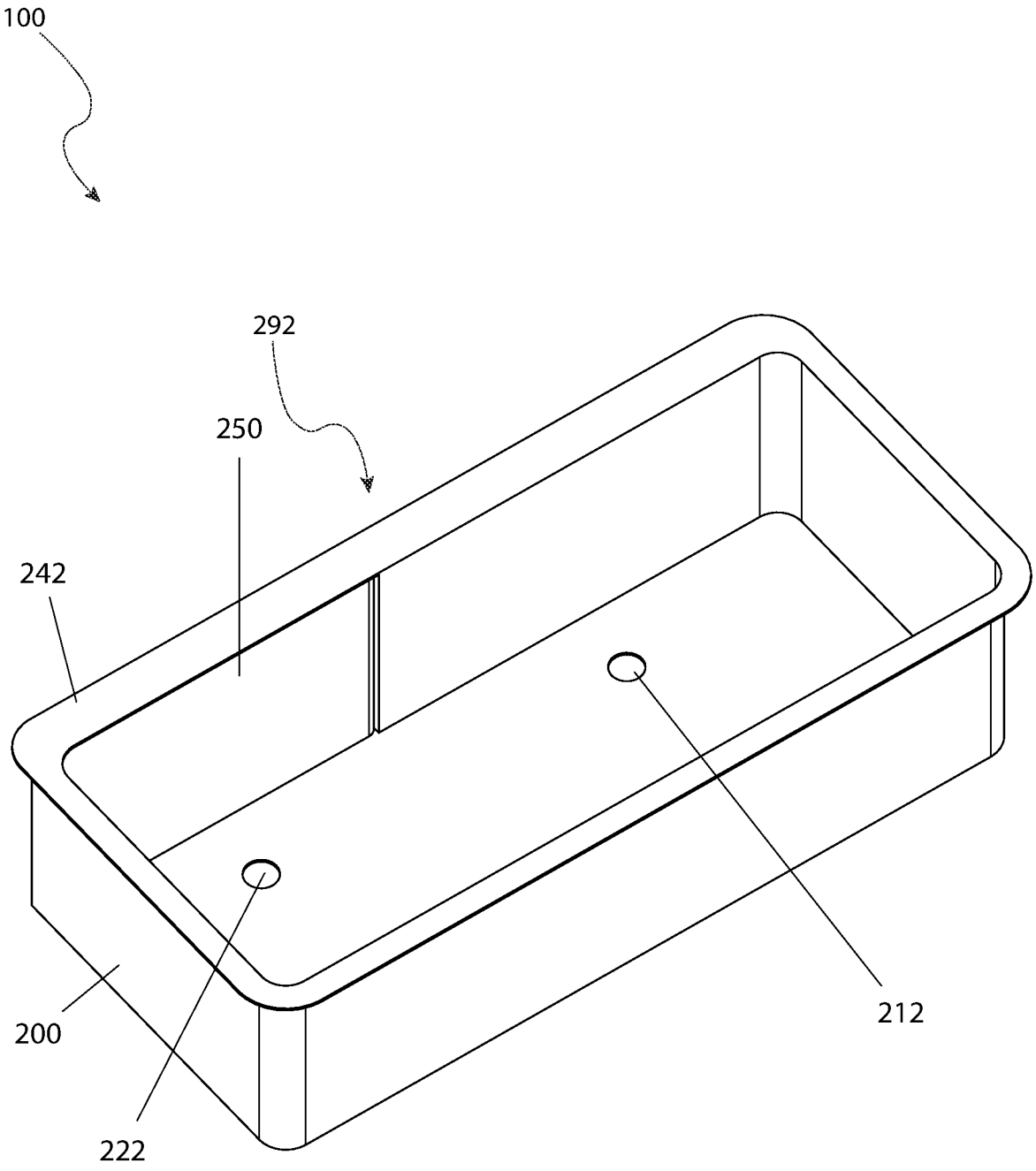
FIG. 2 is an isometric view of a kitchen sink with hinged divider, according to an embodiment of the present invention, illustrating the divider in the non-divided position.
Figure 3:
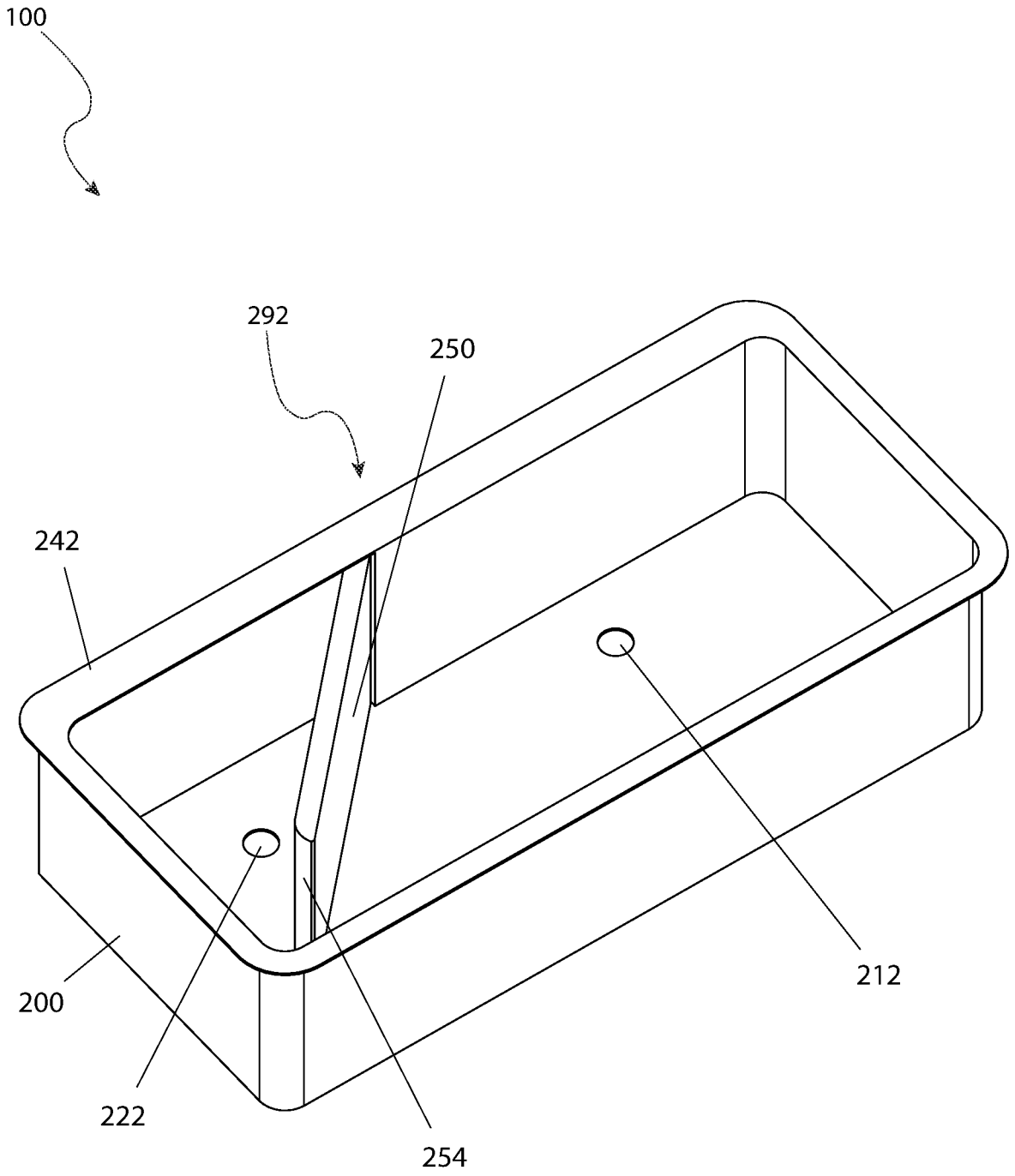
FIG. 3 is an isometric view of a kitchen sink with hinged divider, according to an embodiment of the present invention, illustrating the divider in an elevated and intermediate position.
Figure 4:
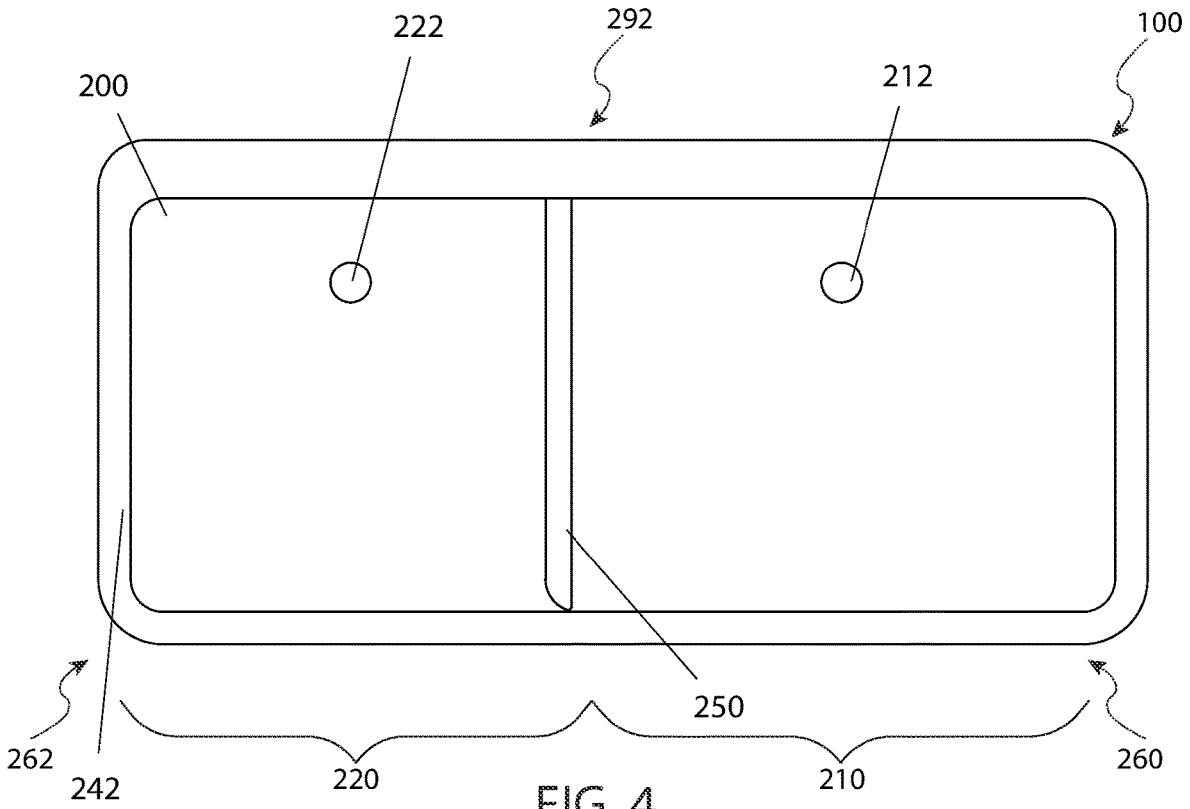
FIG. 4 is a top view of a kitchen sink with hinged divider, according to an embodiment of the present invention, illustrating the divider in the divided position.
Figure 5:
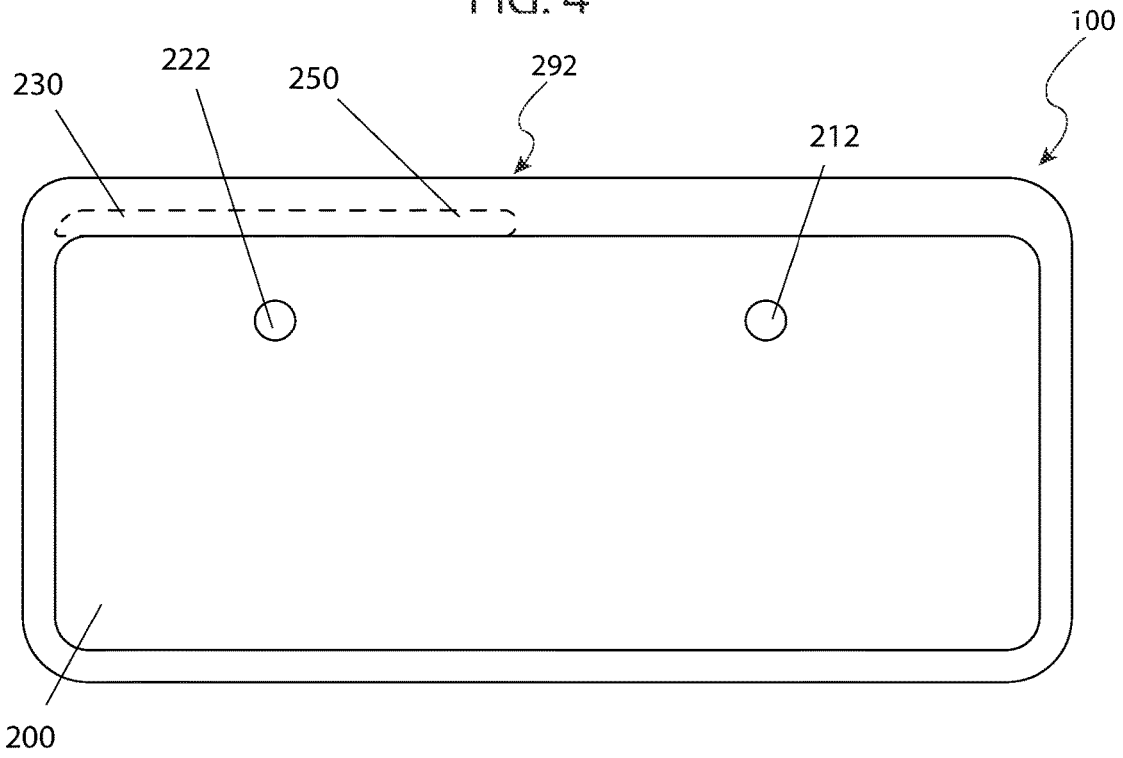
FIG. 5 is a top view of a kitchen sink with hinged divider, according to an embodiment of the present invention, illustrating the divider in the non-divided position.
Figure 6:
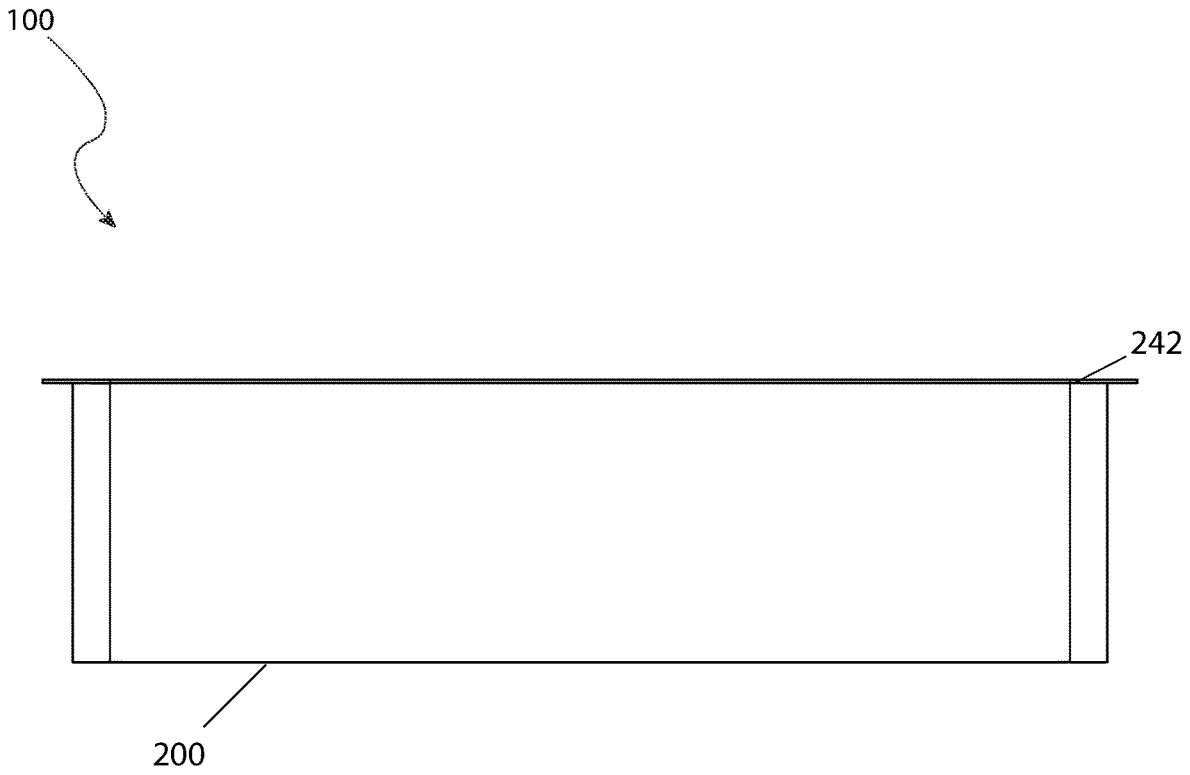
FIG. 6 is a front view of a kitchen sink with hinged divider, according to an embodiment of the present invention.
Figure 7:
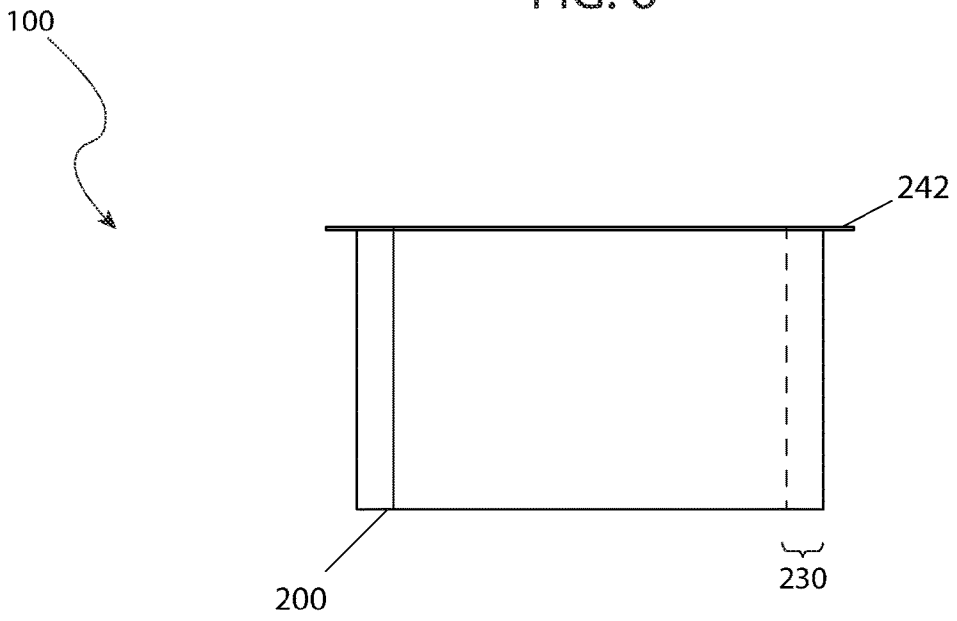
FIG. 7 is a side view of a kitchen sink with hinged divider, according to an embodiment of the present invention.
Figure 8:
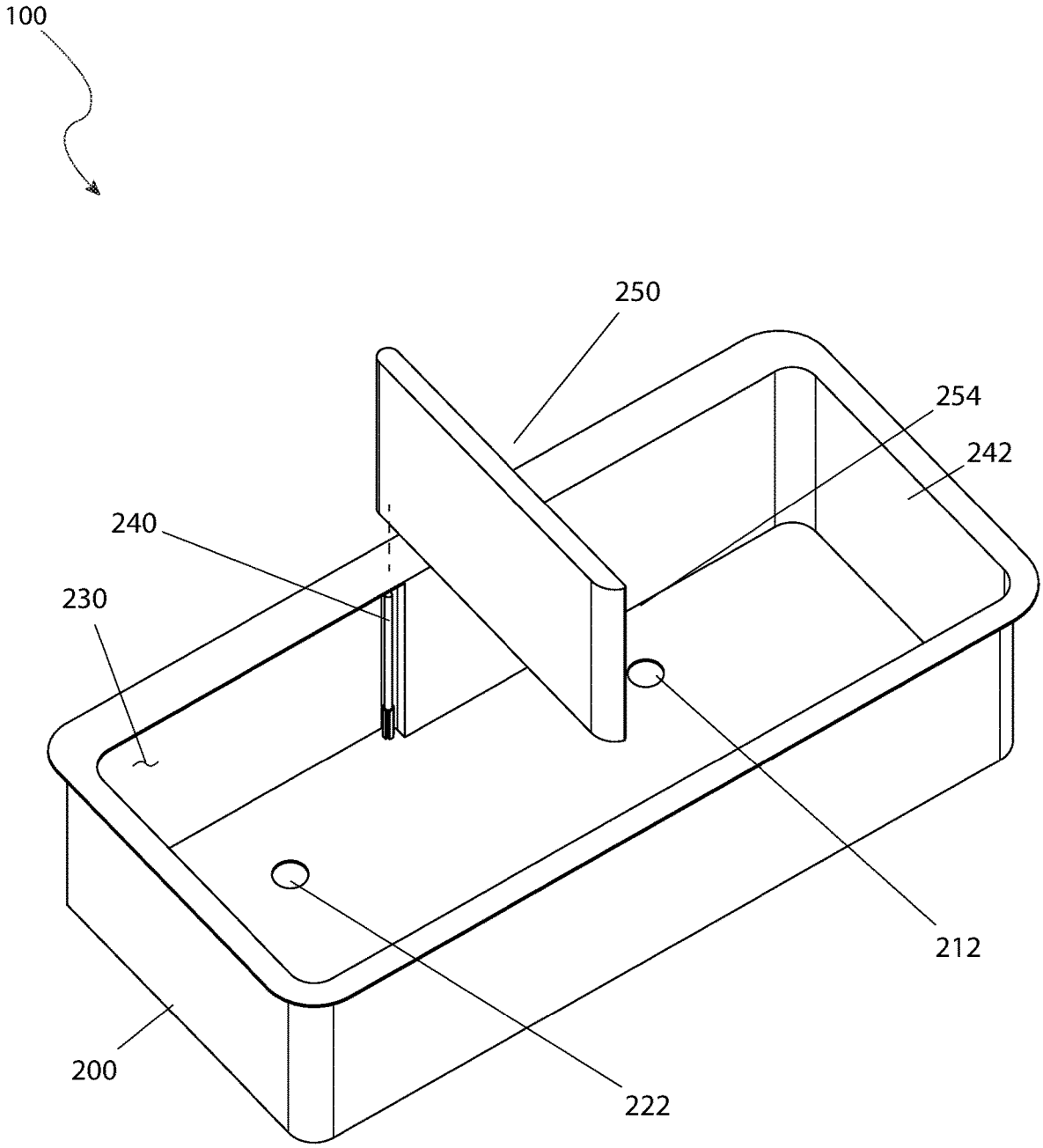
FIG. 8 is an exploded view of a kitchen sink with hinged divider, according to an embodiment of the present invention.
Figure 9:
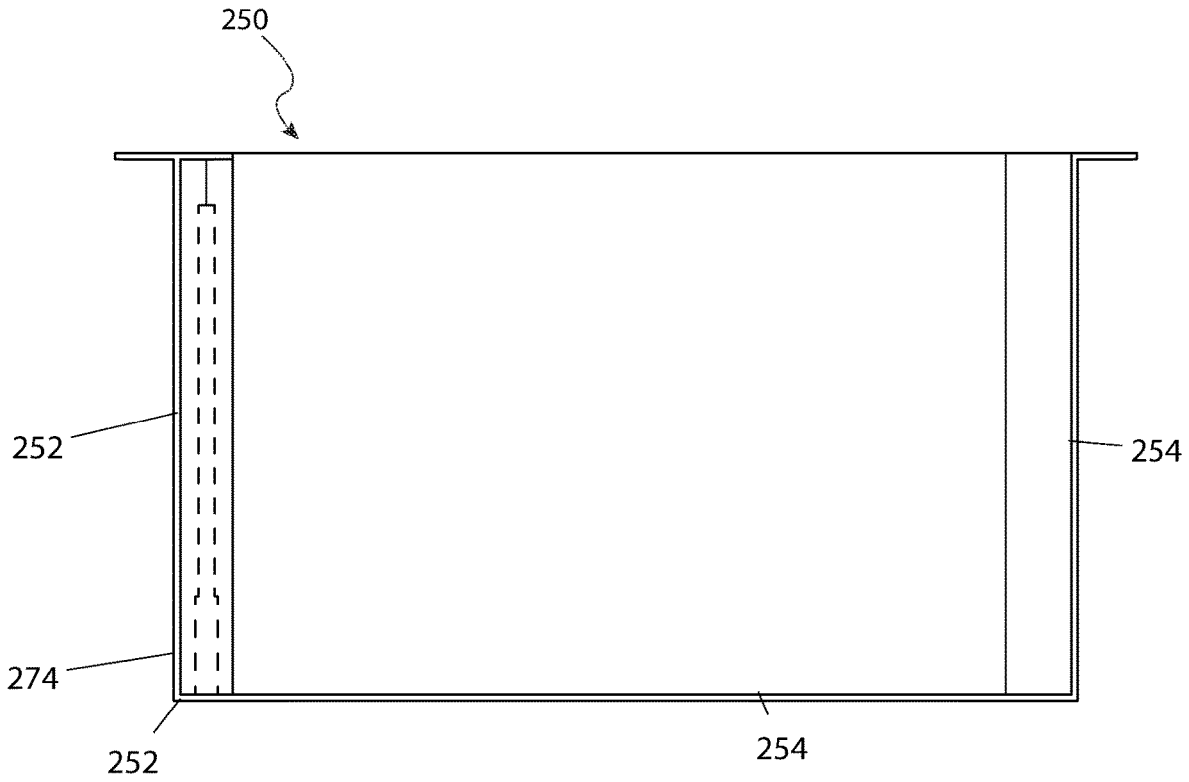
FIG. 9 is a side view of a divider, according to an embodiment of the present invention.
Figure 10:
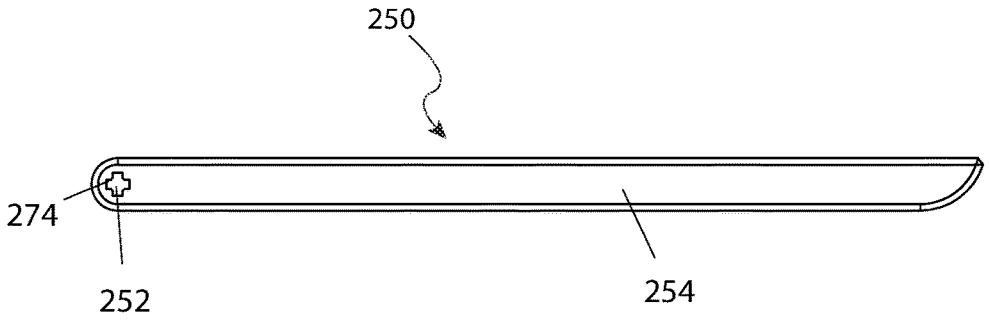
FIG. 10 is a bottom view of a divider, according to an embodiment of the present invention.
Figure 11:
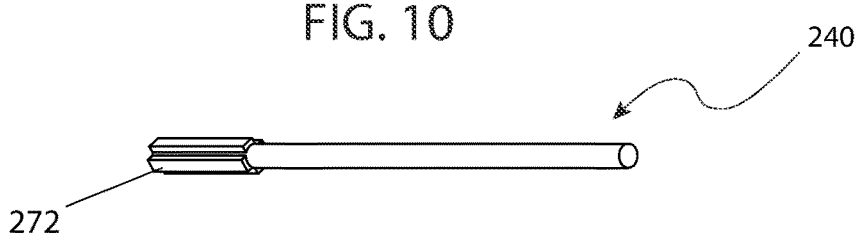
FIG. 11 is an isometric view of a pivot axis, according to an embodiment of the present invention.
Figure 12:
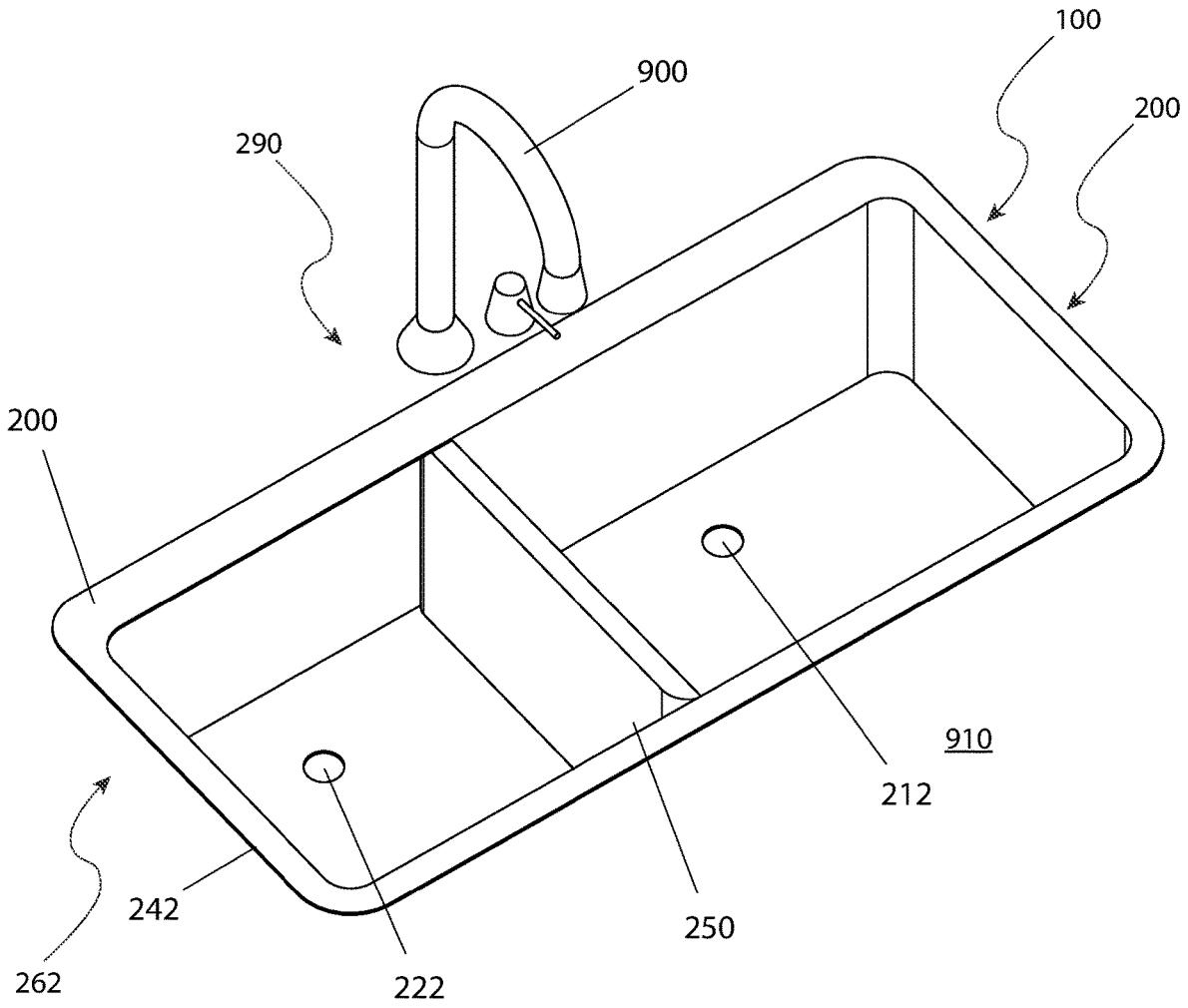
FIG. 12 is an in-use view of a kitchen sink with hinged divider, according to an embodiment of the present invention.

100 kitchen sink
200 sink
210 first section
212 first drain aperture
220 second section
222 second drain aperture
230 pocket
240 pivot axis
242 rim
250 divider
252 pivot aperture
254 seal
260 larger basin
262 smaller basin

272 alignment fins
274 alignment cutout
290 divided position
292 non-divided position
900 source of fresh water
910 counter top

DESCRIPTION OF THE INVENTION

The present invention is directed to a kitchen sink (herein described as the "invention") 100 with a hinged divider 250. The invention 100 may comprise a sink 200 and a divider 250. The divider 250 may pivot between a divided position 290 and a non-divided position 292. The divider 250 may separate a first section 210 of the sink 200 from a second section 220 of the sink 200 when the divider 250 is in the divided position 290. The first section 210 of the sink 200 and the second section 220 of the sink 200 may be joined when the divider 250 is in the non-divided position 292. The sink 200 may be operable as one (1) smaller basin 262 and one (1) larger basin 260 when the divider 250 is pivoted to the divided position 290 and as a combined singular maximized basin when the divider 250 is pivoted to the non-divided position 292.

The sink 200 may be a plumbing fixture that may provide one (1) or more basins 260, 262 within a kitchen. As non-limiting examples, the sink 200 may be adapted for use when washing utensils, preparing meals and beverages, washing hands, and other kitchen tasks. The sink 200 may be located adjacent to a source of fresh water 900 and the sink 200 may provide one (1) or more connections to a sewage system at the bottom of the sink 200.

The sink 200 may comprise the first section 210 and the second section 220. The boundary between the first section 210 and the second section 220 may be defined by the divided position 290 of the divider 250. With the divider 250 in the divided position 290, the first section 210 and the second section 220 may form the one (1) smaller basin 262 and one (1) larger basin 260. With the divider 250 in the non-divided position 292, the first section 210 and the second section 220 may join to form the combined singular maximized basin.

The first section 210 may comprise a first drain aperture 212 and the second section 220 may comprise a second drain aperture 222. The first drain aperture 212 may be coupled to plumbing and may be operable to drain the first section 210. The second drain aperture 222 may be coupled to plumbing and may be operable to drain the second section 220. The first drain aperture 212, the second drain aperture 222, or both may be operable to drain the combined singular maximized basin when the divider 250 is in the non-divided position 292.

The second section 220 may comprise a pocket 230. The pocket 230 of the second section 220 may provide full capture of the divider 250 when the divider 250 is pivoted to the non-divided position 292. As a non-limiting example, the pocket 230 may be a recessed area at the rear wall of the second section 220 of the sink 200.

The sink 200 may comprise a pivot axis 240. The pivot axis 240 may be located at the rear of the sink 200 adjacent the boundary between the first section 210 and the second section 220 and within a rear inner wall of the pocket 230 of the second section 220. The pivot axis 240 may be a vertically-oriented shaft that establishes the axis of rotation of the divider 250.

In some embodiments, the sink 200 may comprise a rim 242. The rim 242 may be a lip that surrounds the top of the sink 200 such that the sink 200 may be lowered into a sink aperture of a countertop 910.

The divider 250 may be a vertically-oriented wall that may pivot between the divided position 290 and the non-divided position 292. The divider 250 may comprise a pivot aperture 252 located on the bottom rear of the divider 250. The divider 250 may be lowered onto the pivot axis 240 by placing the pivot axis 240 into the pivot aperture 252.

The divider 250 may comprise a seal 254. The seal 254 may be a rubberized material that may create a watertight barrier between the smaller basin 262 and larger basin 260 and may prevent the contents thereof from intermixing.

In some embodiments, the invention 100 may comprise an alignment lock. The alignment lock may prevent the divider 250 from pivoting due to forces applied by the contents of the smaller basin 262 and larger basin 260. Specifically, the alignment lock may prevent the divider 250 from pivoting when the divider 250 is in the divided position 290 or the non-divided position 292 unless the alignment lock is first disengaged.

As a non-limiting example, the alignment lock may comprise alignment fins 272 that are located on the base of the pivot axis 240 and alignment cutouts 274 that are located at the bottom of the pivot aperture 252. The alignment fins 272 may project radially from the base of the pivot axis 240 and may be aligned orthogonally with the rear wall of the sink 200. The alignment cutouts 274 may be lateral extensions of the pivot aperture 252 that may be oriented orthogonally to the sides of the divider 250. The alignment cutouts 274 may be larger than the alignment fins 272 such that the alignment fins 272 may pass into the alignment cutouts 274 when the divider 250 is lowered onto the pivot axis 240 in the divided position 290 or the non-divided position 292.

The alignment lock may be disengaged by lifting the divider 250 such that the alignment cutouts 274 clear the alignment fins 272. The divider 250 may be pivoted while the divider 250 is lifted to disengage the alignment lock. The divider 250 may be lowered when the divider 250 is in the divided position 290 or the non-divided position 292 to engage the alignment fins 272 in the alignment cutouts 274 and thus prevent pivoting.

In some embodiments, the divider 250 may pivot along a horizontal axis such that the divider 250 swings towards the bottom of the sink 200 in order to join the smaller basin 262 and larger basin 260 and the pocket 230 may be form the lowest point in the second section 220. The invention 100 may be applicable to sinks of all sizes. In a preferred embodiment, the sink 200 may be made of stainless steel.

In use, the divider 250 may be pivoted to the divided position 290 to divide the sink 200 into a smaller basin 262 and a larger basin 260. As non-limiting examples, the smaller basin 262 and larger basin 260 may enable simultaneous activities and/or may conserve water. The divider 250 may be pivoted to the non-divided position 292 to join the smaller basin 262 and larger basin 260 into a combined singular maximized basin. As non-limiting examples, the combined singular maximized basin may enable washing large or oversized items such as pans, trays, or cutting boards.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A kitchen sink comprising:

a first section having a first drain aperture;

a second section having a second drain aperture;

a divider pivotally connected to the sink, wherein the divider pivots between a divided position, in which the divider separates the first section from the second section, and a non-divided position, in which the first section and the second section are joined to form a combined singular maximized basin;

a pocket located within the second section of the sink, wherein the pocket provides full capture of the divider when the divider is in the non-divided position;

a pivot axis located at a rear of the sink, adjacent the boundary between the first section and the second section, and within a rear inner wall of the pocket of the second section, wherein the pivot axis allows the divider to rotate between the divided and non-divided positions;

a seal located on the divider, the seal being made of a rubberized material and creating a watertight barrier between the first section and the second section when the divider is in the divided position, preventing the contents of the first section and the second section from intermixing; and, an alignment lock to prevent the divider from pivoting when in the divided or non-divided positions unless the alignment lock is disengaged, the alignment lock comprising alignment fins located on a base of the pivot axis and alignment cutouts located at the bottom of a pivot aperture on the divider, wherein the alignment fins and cutouts engage to secure the divider in position.

* * * * *